US007145092B2

(12) United States Patent
Tuhkala

(10) Patent No.: US 7,145,092 B2
(45) Date of Patent: Dec. 5, 2006

(54) KEYBOARD STRUCTURE

(75) Inventor: Marko Tuhkala, Kangasala (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 11/079,989

(22) Filed: Feb. 25, 2005

(65) Prior Publication Data

US 2006/0191780 A1 Aug. 31, 2006

(51) Int. Cl.
*H01H 13/70* (2006.01)

(52) U.S. Cl. ..... 200/515

(58) Field of Classification Search ..... 200/512–517
See application file for complete search history.

(56) References Cited

U.S. PATENT DOCUMENTS 4,046,975 A * 9/1977 Seeger, Jr. ..... 200/515
4,460,810 A * 7/1984 Fukukura ..... 200/5 A
4,570,039 A * 2/1986 Osawa et al. ..... 200/5 A
5,901,834 A * 5/1999 Inubushi et al. ..... 200/314
6,441,330 B1 * 8/2002 Liao ..... 200/515
6,491,456 B1 12/2002 Shih et al.
6,531,671 B1 * 3/2003 Yeh ..... 200/515
6,548,778 B1 * 4/2003 Takahashi ..... 200/516

FOREIGN PATENT DOCUMENTS

EP 0 322 515 7/1989

* cited by examiner

*Primary Examiner*—Michael A. Friedhofer

(57) ABSTRACT

A keyboard is disclosed comprising a rigid base member including at least a first surface; the base member including electrical circuitry structures, which structures define a plurality of connection zones on the first surface; the first surface of the base member including a plurality of grooves in order to connect at least some connection zones; a plurality of flexible, resilient domes covering said base member and being aligned with the connection zones on the first surface of the base member; the underside of each of said domes including a conductive surface that is capable of completing an electrical connection at said connection zone when said dome is deflected downwardly against said circuitry structures; wherein each connection zone communicates with at least one of said grooves in such a manner that the air present under said dome is forced into one of said grooves when said dome is deflected downwardly.

24 Claims, 3 Drawing Sheets

KEYBOARD STRUCTURE

FIELD OF THE INVENTION

This invention relates to a keyboard, a mobile device, a method for use in a keyboard and a method for manufacturing a keyboard.

BACKGROUND OF THE INVENTION

There are many types of keyboard systems in use in various types of electronic devices, such as mobile devices. Some of these keyboard systems involve the use of a dome sheet structure over a printed circuit board.

The dome sheet typically includes a plurality of domes in a predetermined pattern, which is aligned with a pattern of switch locations on the printed circuitry. When a dome is depressed or collapsed by finger pressure, it causes a corresponding connection to be made in the underlying switch in the printed circuitry. This may be affected by finger pressure directly on the dome or indirectly by finger pressure on a key positioned over the dome.

When the components are clamped together or bonded during manufacturing, air is trapped under each dome. This air must be vented in some manner to enable the dome to be depressed or collapsed in a controlled and smooth manner when pressing a key. Venting is also required to allow the air pressure to equalize in changing atmosphere situations. Venting prevents mushiness and improves the tactile feel of a key when it is depressed.

Some previous keyboards of this type have included a spacer sheet between the dome sheet and the printed circuitry. A series of slots have been die cut in the spacer sheet to allow air to be forced out from under a dome when the dome is depressed or collapsed.

However, on a large multi-keyed keyboard, the presence of numerous slots causes the spacer sheet to be unsteady and difficult to handle and assemble with the other components during manufacturing. Also the use of a separate spacer sheet is disadvantageous in many manufacturing and assembling processes.

Patent publication U.S. Pat. No. 6,491,456 describes a key signal-generating device, which has a thin film circuit board to generate key signals and a plurality of hollow rubber domes set on the thin film circuit board, which domes are compressed by their corresponding keys to activate the thin film circuit board to generate corresponding signals. The rubber domes have a predetermined space that is filled with air. The thin film circuit board has a top surface and a trench on the top surface. One end of the trench extends into the predetermined space so that the predetermined space is in communication with the atmosphere. When a key is pressed, the corresponding rubber dome is squeezed by the key, causing the air in the predetermined space to exit out to the atmosphere through the trench. This kind of a structure causes a dust problem between key dome and circuit board in continuous use, especially when the keyboard is in a mobile device.

Patent publication EP 0 322 515 A describes a keyboard structure (e.g. for a calculator), which includes a base member having a plurality of channels or a chamber, circuitry defining a plurality of switches in a pattern, and optionally a plurality of domes in registry with the switch sites. The dome sheet is arranged over a printed circuit board, which is in turn supported or carried on the relatively rigid base member. When a dome is depressed or deflected downwardly, the air under the dome passes into a channel or a chamber where it is distributed away from the switch site. A vent aperture communicating between the channel or chamber and the atmosphere may also be included. In this structure there is no dust problem, but this kind of a keyboard is rather complex when considering the required manufacturing process.

SUMMARY OF THE INVENTION

Now, a solution has been invented, which represents an improvement in venting techniques in a keyboard, such as is used in a mobile device, for example.

To attain this purpose, the keyboard comprises a substantially rigid base member including a first surface; at least a first layer being part of the electrical circuitry structures and arranged on the first surface; the first layer defining at least two individual key locations, each arranged with a connection zone; a sheet covering said base member and with at least two resilient key domes arranged to be aligned with the individual connection zones of the at least two key locations; at least one groove arranged in the first layer and extending between the at least two key locations, said groove forming, together with the sheet, a closed tunnel between said at least two key locations, providing air ventilation between said at least two key domes.

The invention further relates to a mobile device comprising a keyboard, which keyboard comprises a substantially rigid base member including a first surface; at least a first layer being part of the electrical circuitry structures and arranged on the first surface; the first layer defining at least two individual key locations, each arranged with a connection zone; a sheet covering said base member and with at least two resilient key domes arranged to be aligned with the individual connection zones of the at least two key locations; at least one groove arranged in the first layer and extending between the at least two key locations, said groove forming, together with the sheet, a closed tunnel between said at least two key locations, providing air ventilation between said at least two key domes.

In addition, the invention relates to a method of use of a keyboard, which keyboard comprises a substantially rigid base member including a first surface; at least a first layer being part of the electrical circuitry structures and arranged on the first surface; the first layer defining at least two individual key locations, each arranged with a connection zone; a sheet covering said base member and with at least two resilient key domes arranged to be aligned with the individual connection zones of the at least two key locations; at least one groove arranged in the first layer and extending between the at least two key locations, said groove forming, together with the sheet, a closed tunnel between said at least two key locations, providing air ventilation between said at least two key domes; in which method air is directed away from under the dome by means of said grooves when said dome is deflected downwardly.

The invention further relates to a method for manufacturing air tunnels of a keyboard, which keyboard comprises a substantially rigid base member including a first surface; at least a first layer being part of the electrical circuitry structures and arranged on the first surface; the first layer defining at least two individual key locations, each arranged with a connection zone; a sheet covering said base member and with at least two resilient key domes arranged to be aligned with the individual connection zones of the at least two key locations; at least one groove arranged in the first layer and extending between the at least two key locations, said groove forming, together with the sheet, a closed tunnel between said at least two key locations, providing air ventilation between said at least two key domes; wherein the grooves are formed in the first layer during circuit board processing.

In one embodiment the air tunnels will be made into a base member of the keyboard (for example a printed circuit board or a printed wiring board) by leaving a soldering mask open from the tunnel position. In another embodiment the air tunnels are increased by also leaving copper and/or one layer open from the tunnel position. In this manner it is possible to get the running change into use faster.

In another embodiment air is directed from the downward deflected dome to other domes.

The different embodiments of the invention offer several advantages over solutions of prior art. Depending on the implementation manner of the embodiment, the invention may provide, for example, one or more of the following advantages:

- in many solutions the keyboard according to the present invention is cheaper to manufacture because it has a small number of separate components or layers
- it is faster to implement into practical devices than known structures
- it is a cheaper way to implement closed air tunnels than the known structures
- the dust problem between the key dome and the base can be avoided because the air tunnels are not open to atmosphere and the air communicates in a closed space between the domes
- the functionality of the keyboard remains the same as with more expensive structures
- the keyboard can be designed to be thin to suit modern small sized mobile devices An important benefit of the invention is that the air tunnels can now in most cases be made with a normal printed circuit board or a printed wiring board process, which means that no extra manufacturing phases need to be introduced.

DESCRIPTION OF THE DRAWINGS

In the following, the invention will be described in more detail with reference to the appended principle drawings, in which.

For the sake of clarity, the figures only show the details necessary for understanding the invention. The structures and details, which are not necessary for understanding the invention and which should be evident to anyone skilled in the art, have been omitted from the figures in order to emphasize the essential characteristics of the invention.

In addition, the dimensions and scale of the figures are not necessarily correct. The dimensions in the figures have been selected only in order to emphasize the essential characteristics of the invention.

Now, the invention will be described using examples of some possible embodiments of the invention.

DETAILED DESCRIPTION OF THE INVENTION

The drawings illustrate a keyboard of the type that is useful, for example, in a mobile device or any other electronic device including switches and a keyboard. The mobile device could be a mobile phone, a communication device, an electronic notebook, a palm computer or a laptop computer etc.

The keyboard includes a rigid base member 1, which may be, for example, the base material of a printed circuit board or a printed wiring board, typically of dielectric material. It is dimensionally substantially stable and may vary in thickness so long as it retains its shape and provides a firm support. The base member 1 includes electrical circuitry structures on its surface, which structures define a plurality of connection zones 2 on the first surface 1*a*. The electrical circuitry structures of the base member 1 also comprise one or more dielectric layers 3, on which the required conductive paths are located.

Figure 2:
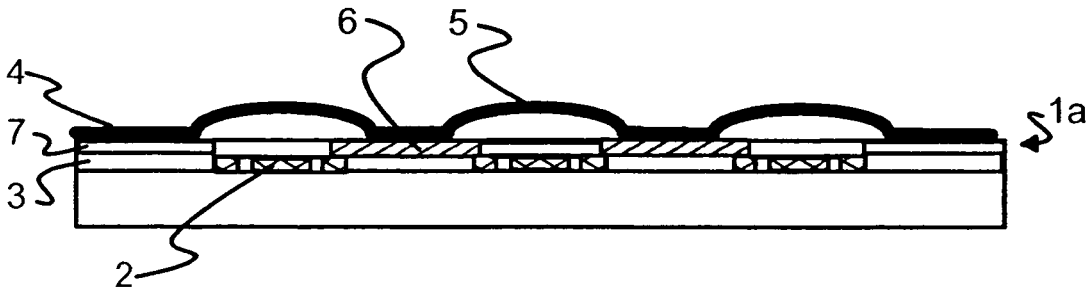
FIG. 2 shows the embodiment according to FIG. 1 with a dome sheet in a side view

The keyboard also includes a dome sheet 4 covering said base member 1, as illustrated in FIG. 2. The dome sheet 4 includes a plurality of flexible, resilient domes 5. These domes 5 are aligned with the connection zones 2 on the first surface 1*a* of the base member 1. In one embodiment the underside of each of said domes 5 includes a conductive surface, which is capable of completing an electrical connection at said connection zone 2 when said dome is deflected downwardly against said circuitry structures. In addition, it is also possible to use other connection principles, such as, for example a capacitive principle.

The surface 1*a* of the base member 1 includes a plurality of grooves 6. These grooves 6 form closed air tunnels together with the dome sheet 4. These air tunnels connect at least two domes 5 together in such a manner that air movement between said domes becomes possible. The domes 5 are interconnected together in order to provide a pathway for air movement when one of the domes 5 is depressed or collapsed toward a respective connection zone 2, as described in more detail hereafter. Each connection zone 2 on the base member 1 communicates with at least one such groove 6. If desired, all of the grooves 6 and/or the air tunnels may interconnect with each other and/or with all of the domes 5. The grooves 6 may have varying configurations so long as they are capable of allowing air to move therethrough when a dome 5 is depressed. The air tunnels can be between two or more domes 5, but they do not necessarily have to connect all the domes together. The domes 5 on a printed wiring board can form several separate groups connected by tunnels. Thus, the planning of a printed wiring board is easier than when all the domes 5 should be connected to each other with tunnels.

Figure 1:
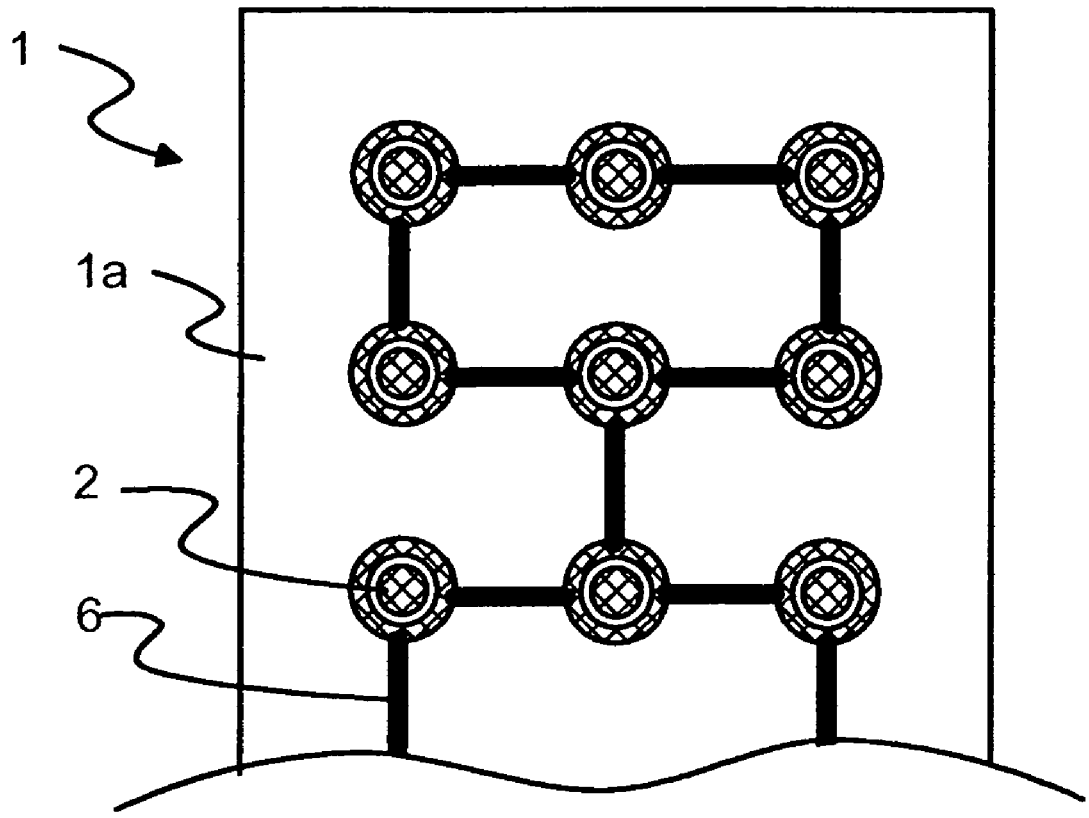
FIG. 1 shows a base member according to the invention in a front view

It should be noted that FIG. 1 shows the base member 1 only in a partial figure and the curved line does not depict the edge of said base member. Therefore, the grooves 6 do not reach up to the edges of the base member 1 and do not communicate with the outside atmosphere, but remain sealed inside the base member 1 area.

According to one embodiment of the invention, all connection zones 2 are communicating with each other with the net of the air tunnels when there is no venting to the atmosphere, so that the air from one of the connection zones can be adequately dispersed when such switch is actuated by pressing the dome downwardly. Of course, by making the volume of each air tunnel greater, it is easier to alleviate the extent of air compression when a single switch is actuated. As another alternative, a larger chamber may be provided in the base member 1, into which air may be forced when a switch is actuated.

Figure 3:
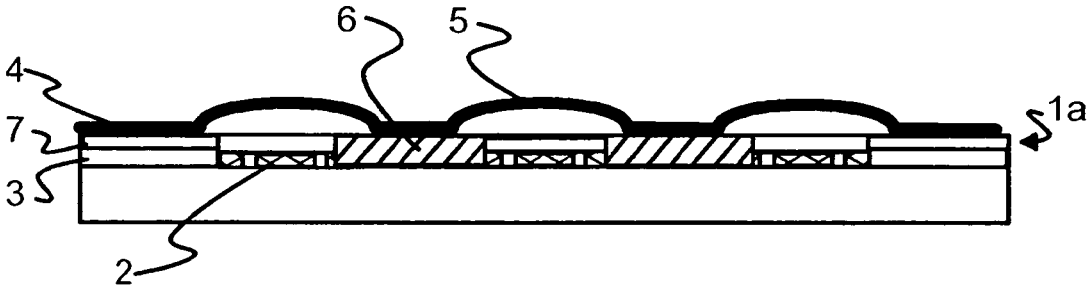
FIG. 3 shows another embodiment in a side view

As illustrated in the drawings, the grooves 6 are provided in the upper surface 1*a* of the base member 1. In this example, the grooves are arranged on a coating layer 3, 7 of the surface 1*a*. These grooves 6 can be made by, for example, leaving the solder mask 7 and/or one layer 3 of copper out of the groove position. The base member 1, such as a printed circuit board or a printed wiring board, comprises at least one thin dielectric layer 3, on which the required conductive paths are located. The thickness of the layer 3 may vary. FIG. 2 illustrates an embodiment of the keyboard of the invention, which includes the grooves 6 made by leaving the solder mask 7 out of the groove position. FIG. 3 illustrates another embodiment of the invention, which includes the grooves 6 made by leaving the solder mask 7 and one layer 3 of copper out of the groove position. By means of this invention, it is possible to get the running change faster into use in production and it is also possible to save expenses because the air tunnel can now be made with normal printed circuit board or printed wiring board process, which does not cause any extra expenses. These processes are, for example, exposure, etching, milling, depositing, evaporation and etc.

According to the invention, the grooves 6 can be formed on any layer processed on the actual base member 1, which layer can be processed by means of the above-mentioned processes or other processes for printed wiring board. Thus, the layers can be the above-mentioned solder mask 7 or copper layers, or some other layers, such as, for example, lacquer layers or locally applied solder layers. All these layers are a part of the electrical circuitry structures of the invention.

The grooves 6 can also be made in other coating layers 3, 7 than in the previous examples, as illustrated in FIGS. 2 and 3. The grooves 6 may be entirely on one layer or on several layers. If necessary, the thickness of the layer, such as, for example copper, can be adjusted in order to reach the correct depth of the grooves.

The thickness and other dimensions of the layer 3 and the solder mask 7 and/or other coating layers in the figures do not necessarily correspond to the situation in reality. Usually these regions are very thin, but by drawing the regions thicker in the figures the invention can be understood better.

Overlying the base member 1, a spacer member may be included. The spacer member is optional. Its presence is preferred, however, because it increases the distance the dome 5 can travel as it is being depressed or collapsed. This provides a better "feel" to the key being operated. The spacer member is preferably in the form of a sheet having a uniform thickness and having openings or cut-outs in a pattern that corresponds to the locations of the connection zones 2. The spacer member is preferably a dielectric material. A typical spacer member is polyester film (which may be rigid or flexible). Alternatively, the spacer member may be conductive so long as it is electrically insulated from the printed circuitry.

Positioned over the base member 1 (or in some embodiments over the spacer member) is the dome sheet 4. This dome sheet 4 includes a pattern of raised domes 5, which are aligned with the connection zones 2 on the base member 1. When the dome sheet 4 is dielectric (e.g. plastic) material, the bottom surface of each dome 5 includes a thin conductive layer or coating. For example, the layer may comprise a conductive ink or conductive particles in a polymerized coating. The dome sheet 4 may comprise a thin metal sheet (e.g., cold rolled stainless steel). As another alternative, strips may be provided, which each include a plurality of domes 5.

The dome sheet 4 is flexible and resilient so that each dome 5 can be downwardly depressed or collapsed by means of finger pressure (arrow 8) and will then return to its original shape and position when the finger pressure is released. The size and shape of each dome 5 is often substantially the same. Other sizes and shapes may, of course, be used in this invention.

Figure 4:
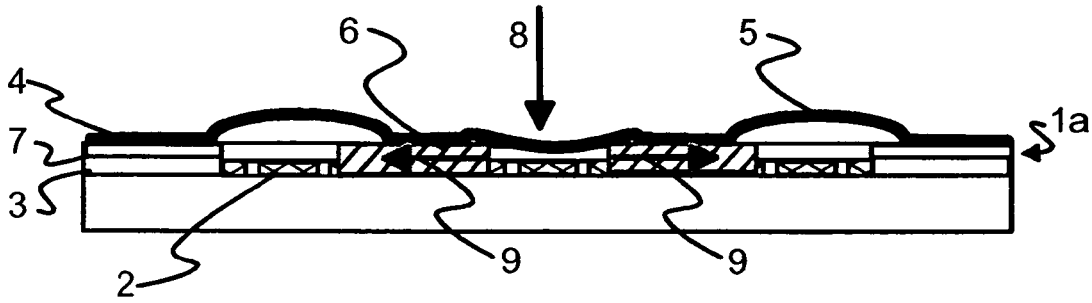
FIG. 4 shows some air flows in the keyboard according to FIG. 3

When finger pressure (arrow 8) is used to depress or collapse a dome 5 (e.g. as illustrated in FIG. 4), the underside part of the dome comes into contact with the base member 1 at a connection zone 2. At the same time the air (arrow 9) present under dome 5 is forced into an air tunnel (groove 6). This allows the air (arrow 9) to dissipate through the air tunnel system. If desired, a vent aperture communicating between the air tunnel and the atmosphere may also be included. This is not required, however, and could allow dust or/and moisture to enter the keyboard.

The dome sheet 4 may be bonded to the top of the base member 1 (or to the top of the spacer member, if present) or it may be clamped in place.

Figure 5:
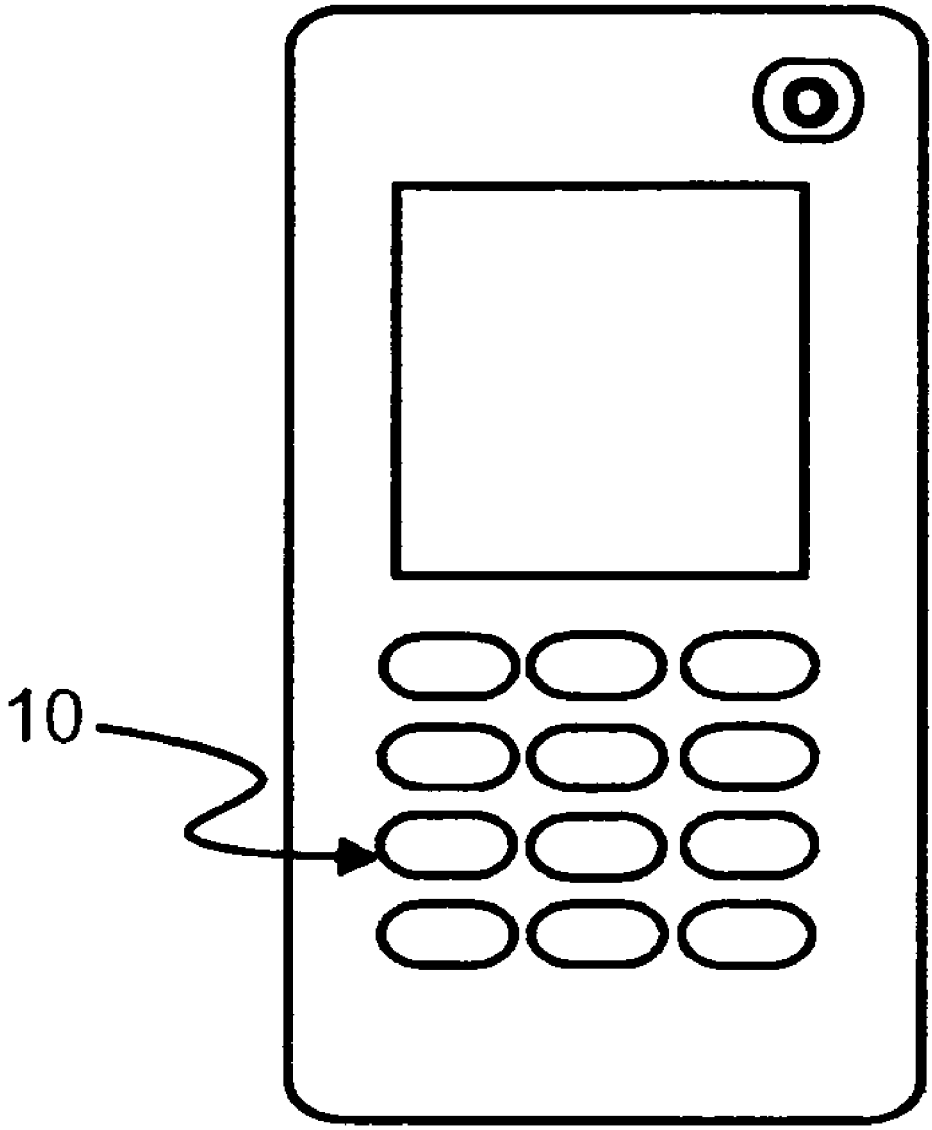
FIG. 5 shows a mobile device.

The mobile device could be a mobile phone, a communication device, an electronic notebook, a palm computer or a laptop computer etc. FIG. 5 shows a mobile phone comprising a keyboard 10, which keyboard has been presented above.

By combining, in various ways, the modes and structures disclosed in connection with the different embodiments of the invention presented above, it is possible to produce various embodiments of the invention in accordance with the spirit of the invention. Therefore, the above-presented examples must not be interpreted as restrictive to the invention, but the embodiments of the invention may be freely varied within the scope of the inventive features presented in the claims hereinbelow.

What is claimed is:

1. Keyboard comprising a substantially rigid base member including a first surface;

at least a first layer being part of electrical circuitry structures and arranged on the first surface;

the first layer defining at least two individual key locations, each arranged with a connection zone;

a sheet covering said base member and with at least two resilient key domes in alignment with the individual connection zones of the at least two key locations;

at least one groove arranged in the first layer and extending between the at least two individual key locations, said groove forming, together with the sheet, a closed tunnel between said at least two individual key locations, providing air ventilation between said at least two key domes.

2. The keyboard according to claim 1, wherein the first layer is a conductive layer and the at least one groove is arranged at least partly in the conductive layer.

3. The keyboard according to claim 1, wherein the first layer is a coating layer and the at least one groove is arranged at least partly in the coating layer.

4. The keyboard according to claim 1, wherein the first layer is a solder mask layer and the at least one groove is arranged at least partly in the solder mask layer.

5. The keyboard according to claim 1, wherein the base member also comprises a second layer of conductive material and the at least one groove is arranged at least partly in said second layer.

6. The keyboard according to claim 1, wherein the base member also comprises a second layer of dielectric material and the at least one groove is arranged at least partly in said second layer.

7. The keyboard according to claim 1, wherein an underside of each of said domes includes a conductive surface that is capable of completing an electrical connection at said connection zone when said dome is deflected downwardly against said circuitry structures.

8. Mobile device comprising a keyboard, which keyboard comprises a substantially rigid base member including a first surface;

at least a first layer being part of electrical circuitry structures and arranged on the first surface;

the first layer defining at least two individual key locations, each arranged with a connection zone;

a sheet covering said base member and with at least two resilient key domes in alignment with the individual connection zones of the at least two key locations;

at least one groove arranged in the first layer and extending between the at least two individual key locations, said groove forming, together with the sheet, a closed tunnel between said at least two individual key locations, providing air ventilation between said at least two key domes.

9. Method of use of a keyboard, which keyboard comprises a substantially rigid base member including a first surface;

at least a first layer being part of electrical circuitry structures and arranged on the first surface;

the first layer defining at least two individual key locations, each arranged with a connection zone;

a sheet covering said base member and with at least two resilient key domes in alignment with the individual connection zones of the at least two key locations;

at least one groove arranged in the first layer and extending between the at least two individual key locations, said groove forming, together with the sheet, a closed tunnel between said at least two individual key locations, providing air ventilation between said at least two key domes; said method comprising:

deflecting one of said domes downwardly, and directing air away from under said dome by means of said at least one groove.

10. The method according to claim 9, wherein air is directed from the downwardly deflected dome to another one of said domes.

11. Method for manufacturing a keyboard, which keyboard comprises providing a substantially rigid base member including a first surface;

providing at least a first layer being part of electrical circuitry structures and arranged on the first surface, the first layer defining at least two individual key locations, each arranged with a connection zone;

providing a sheet covering said base member and with at least two resilient key domes in alignment with the individual connection zones of the at least two key locations;

arranging at least one groove in the first layer and extending between the at least two individual key locations, said groove forming, together with the sheet, a closed tunnel between said at least two individual key locations, providing air ventilation between said at least two key domes; and forming the at least one groove in the first layer during circuit board processing.

12. The method according to claim 11, wherein the at least one groove is formed by etching.

13. The method according to claim 11, wherein the first layer is a conductive layer and the at least one groove is arranged at least partly in the conductive layer.

14. The method according to claim 11, wherein the first layer is a coating layer and the at least one groove is formed at least partly in the coating layer.

15. The method according to claim 11, wherein the first layer is a solder mask layer and the at least one groove is formed at least partly in the solder mask layer.

16. The method according to claim 11, wherein the first layer is a layer of conductive material and the at least one groove is formed at least partly in said layer.

17. Apparatus, comprising:

means for providing a substantially rigid base including a first surface;

means for providing at least a first layer being part of electrical circuitry structures and arranged on the first surface, the first layer defining at least two individual key locations, each arranged with a connection zone;

means for covering said base member and with at least two resilient key domes in alignment with the individual connection zones of the at least two key locations;

at least one groove arranged in the first layer and extending between the at least two individual key locations, said groove forming, together with the means for covering, a closed tunnel between said at least two individual key locations, providing air ventilation between said at least two key domes.

18. The apparatus according to claim 17, wherein the first layer is a conductive layer and the at least one groove is arranged at least partly in the conductive layer.

19. The apparatus according to claim 18, wherein the base member also comprises a second layer of dielectric material and the at least one groove is arranged at least partly in said second layer.

20. The apparatus according to claim 17, wherein the first layer is a coating layer and the at least one groove is arranged at least partly in the coating layer.

21. The keyboard according to claim 20, wherein an underside of each of said domes includes a conductive surface that is capable of completing an electrical connection at said connection zone when said dome is deflected downwardly against said circuitry structures.

22. The apparatus according to claim 17, wherein the first layer is a solder mask layer and the at least one groove is arranged at least partly in the solder mask layer.

23. The apparatus according to claim 17, wherein the base member also comprises a second layer of conductive material and the at least one groove is arranged at least partly in said second layer.

24. Mobile device comprising a keyboard, which keyboard comprises:

means for providing a substantially rigid base including a first surface;

means for providing at least a first layer being part of electrical circuitry structures and arranged on the first surface, the first layer defining at least two individual key locations, each arranged with a connection zone;

means for covering said base member and with at least two resilient key domes in alignment with the individual connection zones of the at least two key locations;

at least one groove arranged in the first layer and extending between the at least two individual key locations, said groove forming, together with the means for covering, a closed tunnel between said at least two individual key locations, providing air ventilation between said at least two key domes.

* * * * *